US008777631B1

(12) United States Patent
Fletcher

(10) Patent No.: US 8,777,631 B1
(45) Date of Patent: Jul. 15, 2014

(54) ELONGATED FOCUS PAD

(71) Applicant: Vernon Fletcher, Pasadena, CA (US)

(72) Inventor: Vernon Fletcher, Pasadena, CA (US)

( * ) Notice: Subject to any disclaimer, the term of this patent is extended or adjusted under 35 U.S.C. 154(b) by 0 days.

(21) Appl. No.: 14/223,098

(22) Filed: Mar. 24, 2014

Related U.S. Application Data

(60) Provisional application No. 61/804,989, filed on Mar. 25, 2013.

(51) Int. Cl.
*A63B 69/20* (2006.01)

(52) U.S. Cl.
CPC ..... *A63B 69/20* (2013.01)
USPC ..... 434/247

(58) Field of Classification Search
USPC ..... 434/247, 251, 258; 482/83, 87, 88; 463/47.2
See application file for complete search history.

(56) References Cited

U.S. PATENT DOCUMENTS 3,336,029 A * 8/1967 London ..... 463/47.2
4,328,966 A * 5/1982 Miyamoto ..... 446/473
5,295,926 A * 3/1994 Tanabe ..... 482/12
5,630,998 A * 5/1997 Parsons ..... 434/11
5,700,229 A * 12/1997 Karnofsky ..... 482/83
6,036,602 A * 3/2000 Abbott ..... 463/47.2
6,077,204 A * 6/2000 Dickinson, Jr. ..... 482/83
7,416,517 B2 * 8/2008 Mitchell ..... 482/90
7,625,289 B1 * 12/2009 Fagliarone ..... 463/47.2
7,789,810 B2 * 9/2010 Le ..... 482/83
8,029,422 B2 * 10/2011 Strong et al. ..... 482/83
8,568,242 B2 * 10/2013 Milligan ..... 463/47.7
2014/0024503 A1 * 1/2014 Chiang ..... 482/83

* cited by examiner

*Primary Examiner* — Kurt Fernstrom

(57) ABSTRACT

An elongated focus pad is a combat sport training apparatus that reduces wear and tear experienced by a trainer's body. The elongated focus pad accomplishes this by distancing the impact zone of the focus pad away from the trainer's body. The elongated focus pad incorporates a target section, a barrel, a handle, and an internally positioned flexible core. The flexible core absorbs impact forces experienced by the target section reducing the total force experienced by a trainer's body. The target section is constructed of a flexible material capable of absorbing impacts but allowing for rapid successive strikes. The barrel is attached to the target section and distances it from the handle. The handle is positioned opposite the target section on the barrel and is manipulated by the trainer. The flexible core is internally positioned with the most flexible region being found within the barrel.

15 Claims, 7 Drawing Sheets

ELONGATED FOCUS PAD

The current application claims a priority to the U.S. Provisional Patent application Ser. No. 61/804,989 filed on Mar. 25, 2013.

FIELD OF THE INVENTION

The present invention relates generally to training equipment. More specifically, the present invention relates to a focus pad utilized in combat sports training.

BACKGROUND OF THE INVENTION

In order to become well-rounded, a boxer must focus on both the offensive and defensive aspects of boxing. This mentality is reflected in boxing training regimens in which boxers and their trainers work to develop effective punch combinations as well defensive maneuvers. An effective tool for training in proper technique and form is the focus mitt. Worn by a trainer in pairs, focus mitts are utilized to develop both offensive and defensive aspects of a boxer's repertoire. The focus mitts serve as targets for boxers to punch and are often maneuvered by the trainer to develop specific skills. Trainers employ focus mitts not only to receive the boxer's punches but to go on the offensive against the boxer. The trainers actively provide a counterforce to balance the force generated by a boxer's punches. This ensures that the boxer develops both proper offensive and defensive techniques in a boxing environment with a simulated opponent. While focus mitts prove effective in a training environment, the continual use of the focus mitts over time can cause wear and tear to a trainer's body, particularly in the shoulders.

It is therefore the object of the present invention to provide an elongated focus pad that reduces wear and tear experienced by a trainer's body. The elongated focus pad accomplishes this by distancing the impact zone of the focus pad away from the trainer's body utilizing an elongated flexible member. The flexible member absorbs part of the force experienced by the impact zone reducing the total force that would normally be experienced by a trainer. The elongated focus pad comprises a target section, a barrel, a handle, and a core. The target section is the impact zone constructed of a flexible material capable of absorbing impacts from successive strikes. The barrel distances the target section from the handle. The handle is the portion of elongated focus pad that is manipulated by the trainer. The core is the internally positioned component that provides the elongated focus pad with sufficiently flexibility to absorb impacts but quickly return to its initial position.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
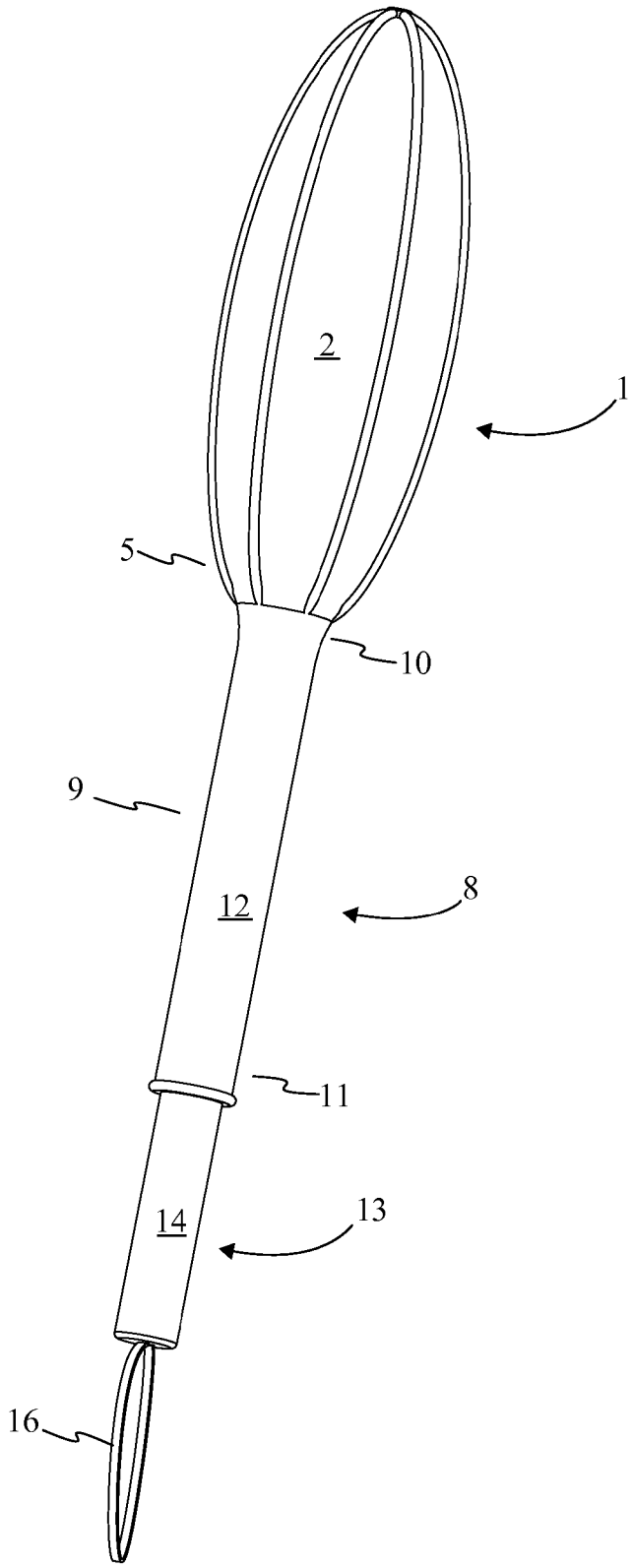
FIG. 1 is a perspective view displaying the elongated focus pad as per the current embodiment of the present invention.
Figure 2:
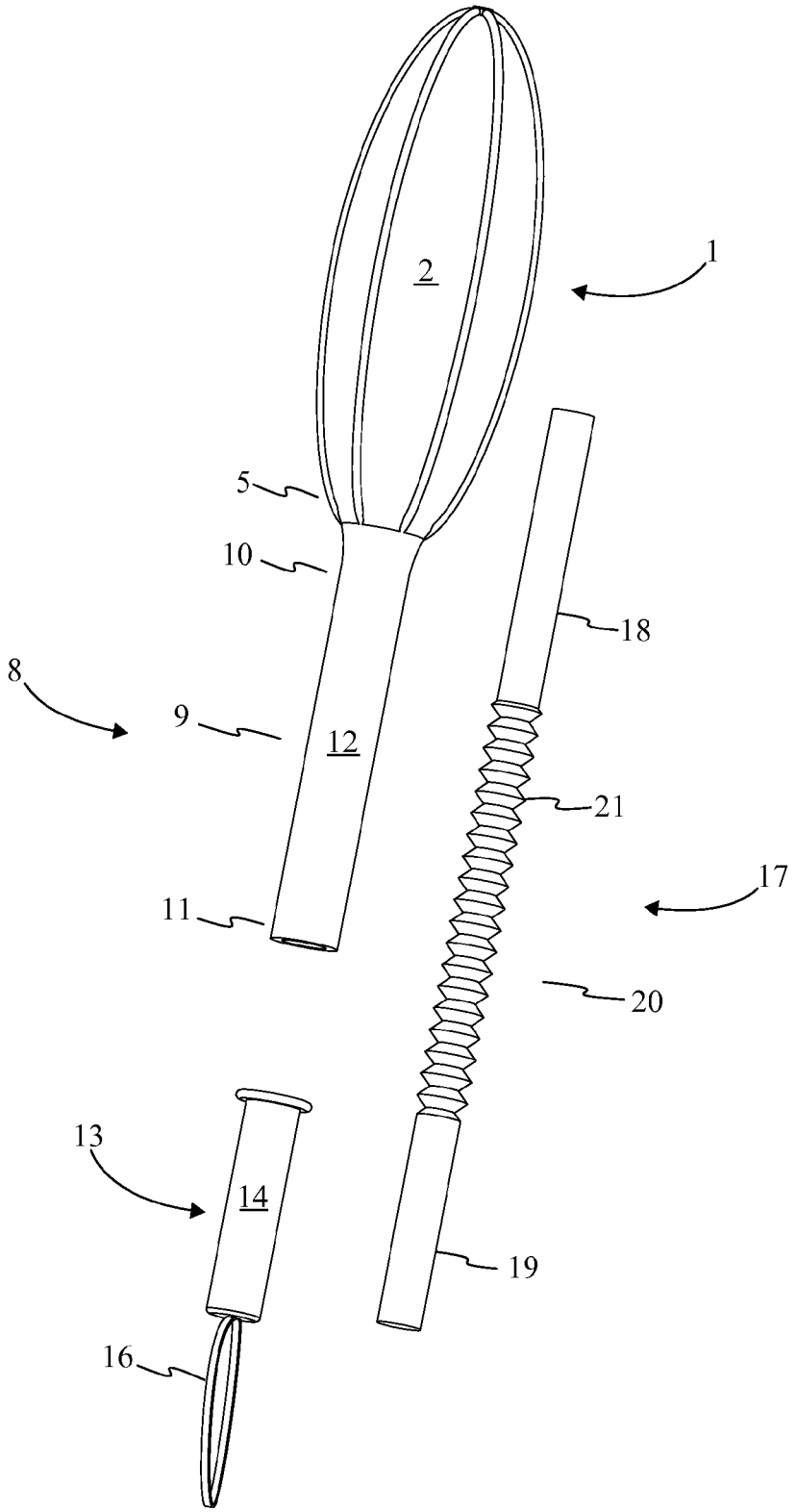
FIG. 2 is an expanded perspective view displaying the core positioned alongside the target section, the barrel, and the handle, relative to the internal position of the current embodiment of the present invention.
Figure 3:
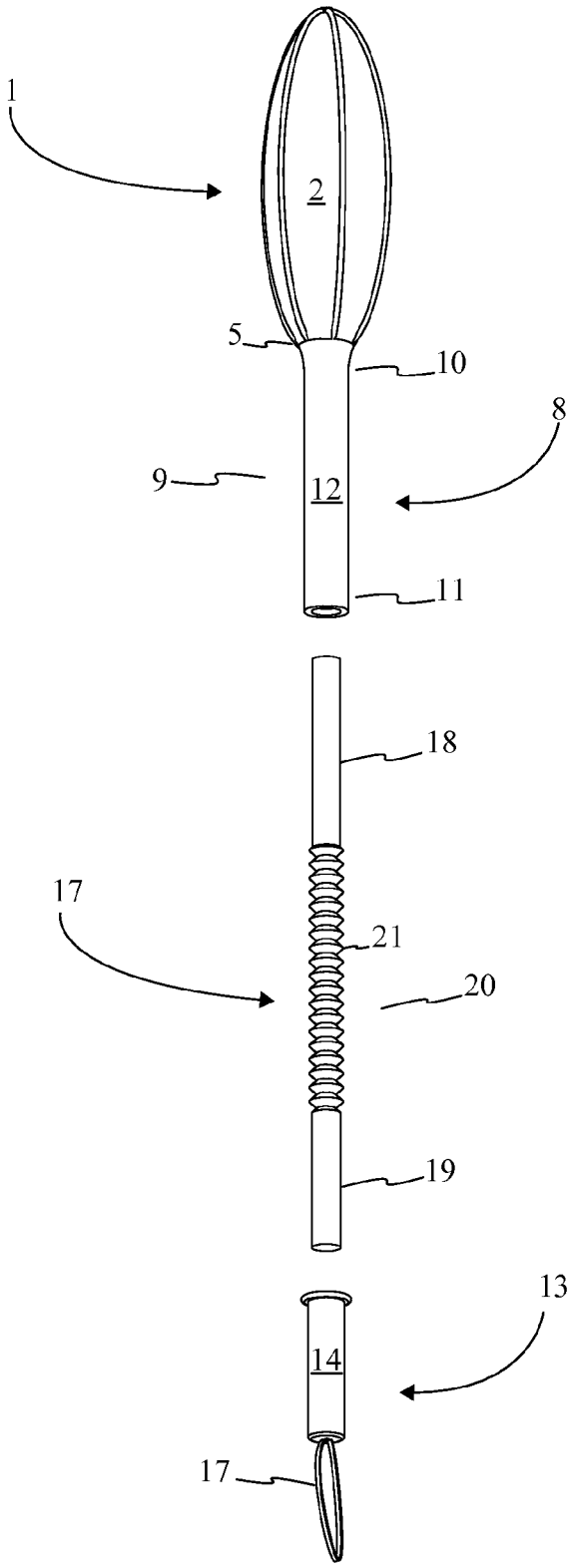
FIG. 3 is an expanded perspective view displaying the components of the elongated focus pad expanded along an axis relative to the internal positioning of the current embodiment of the present invention.

Referencing FIG. 1-3, the present invention is an elongated focus pad that distances the impact zone of a focus pad away from a trainer's body reducing wear to their joints and muscles. In the current embodiment of the present invention, the elongated focus pad comprises a target section 1, a barrel 8, a handle 13, and a core 17. The target section 1 is a rounded padded section that receives an impact during a training session. The target section 1 is found positioned distal to a trainer's hand. The barrel 8 is a cylindrical section that is positioned immediately adjacent to the target section 1. The barrel 8 is padded and closes a flexible region 20 of the core 17. The handle 13 is the component that is manipulated by a trainer. The handle 13 is positioned adjacent to the barrel 8 opposite the target section 1. The core 17 provides a particular elasticity to the elongated focus pad, enabling the target section 1 and the barrel 8 to bounce and return to an initial position following individual impacts during a training session. The core 17 section is found enclosed within the target section 1, the barrel 8, and the handle 13.

Referencing FIG. 1 and FIG. 3, the target section 1, the core 17, the barrel 8, and the handle 13 are found centrally aligned. The central alignment provides the target section 1 the core 17, the barrel 8, and the handle 13 align along an axis that traverses centrally through each component. The central alignment provides a uniform weight distribution about the central axis of the elongated focus pad. The uniform weight distribution facilitates the movement and handling of the elongated focus pad by a trainer during a training session. The core 17 is enclosed within the target section 1, the barrel 8, and the handle 13. The core 17 provides the elongated focus pad with a particular flexibility enabling the target section 1 to bounce and bend in response to impacts during a training session. The flexibility of the core 17 allows multiple strikes to impact the target section 1 in rapid succession. The barrel 8 is positioned between the target section 1 and the handle 13. The positioning of the barrel 8 distances the target section 1 from the handle 13. The barrel 8 surrounds a flexible region 20 of the core 17. The positioning of the flexible region 20 within the barrel 8 provides the target section 1 with a particular elasticity enabling it to return to a resting position after experiencing a strike even in rapid succession.

Figure 4:
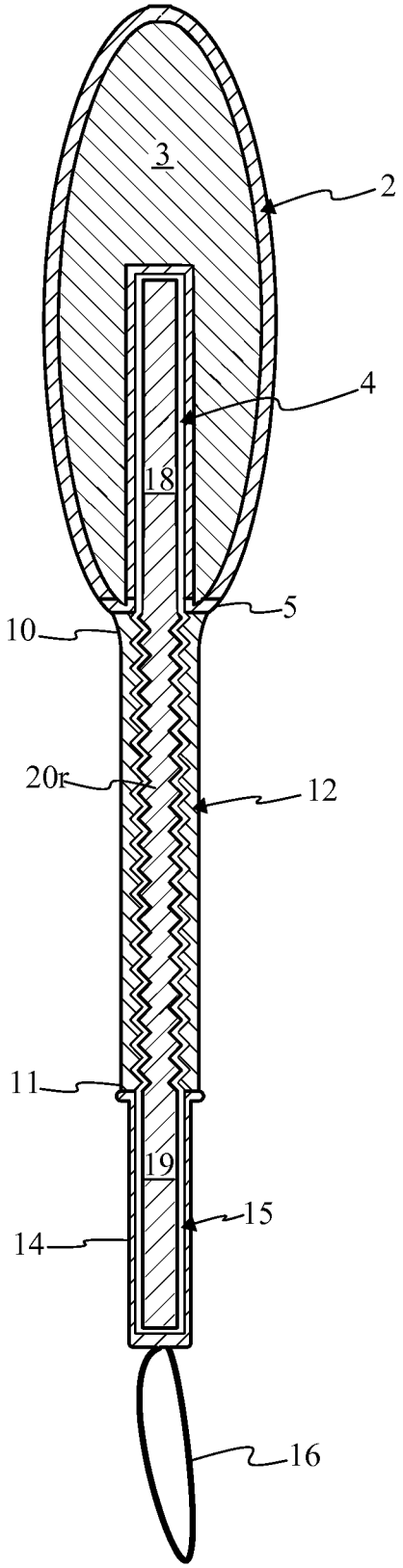
FIG. 4 is a cross sectional view displaying the elongated focus pad with a soft foam material positioned within the target section.
Figure 5:
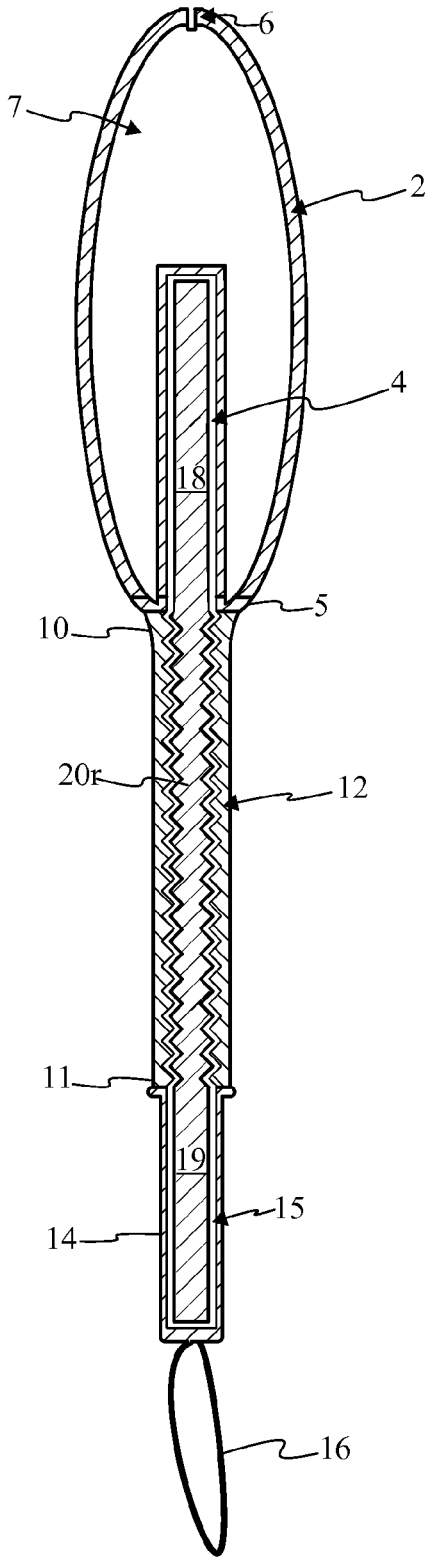
FIG. 5 is a cross sectional view displaying the elongated focus pad with an inflation valve and a bladder positioned within the target section.

Referencing FIG. 3-5, the target section 1 is the portion of the of the elongated focus pad that is impacted during a training session. The target section 1 has a rounded shape that facilitates the movement of said target section 1 during a training session. The target section 1 is centrally aligned with the core 17, the handle 13, and the barrel 8. The target section 1 is positioned immediately adjacent to the barrel 8 opposite the handle 13. The target section 1 partially encloses the core 17. In the current embodiment of the present invention the target section 1 comprises a padded exterior 2, a first core mount 4, and a barrel mount 5. The padded exterior 2 is a soft compressible material that is peripherally positioned to the target section 1. The first core mount 4 is provided as an engageable component for the core 17. The first core mount 4 is centrally positioned within the target section 1 and provides a first section 18 of the core 17 within a secure engagement to the target section 1. The barrel mount 5 is a particularly formed region that tapers the contours of the target section 1 with the barrel 8. The barrel mount 5 is found immediately adjacent to the elongated body 9 of the barrel 8, specifically a first end 10 of the elongated body 9 of the barrel 8 is found coincident with the barrel mount 5 of the target section 1.

Referencing FIG. 2-4, the padded exterior 2 is the soft compressible material that peripherally surrounds the target section 1. In an embodiment of the present invention the target section 1 comprises a soft foam material 3, similar to material utilized in traditional focus pad. The soft foam material 3 is positioned within the interior of the target section 1. In the aforementioned embodiment, the padded exterior 2 encloses the soft foam material 3 within the target section 1. It should be noted that the soft foam material's density and flexibility may vary from or be the same as the density and flexibility of the padded exterior 2. The difference in density would be dependent on the particulars of a training session. It should be noted that in the current embodiment of the present invention, the padded exterior 2 contains a plurality of stitches that extend longitudinally across the surface of the padded exterior 2. The plurality of stitches are utilized as a means of forming the padded exterior 2 into the particular shape of the target section 1.

Figure 6:
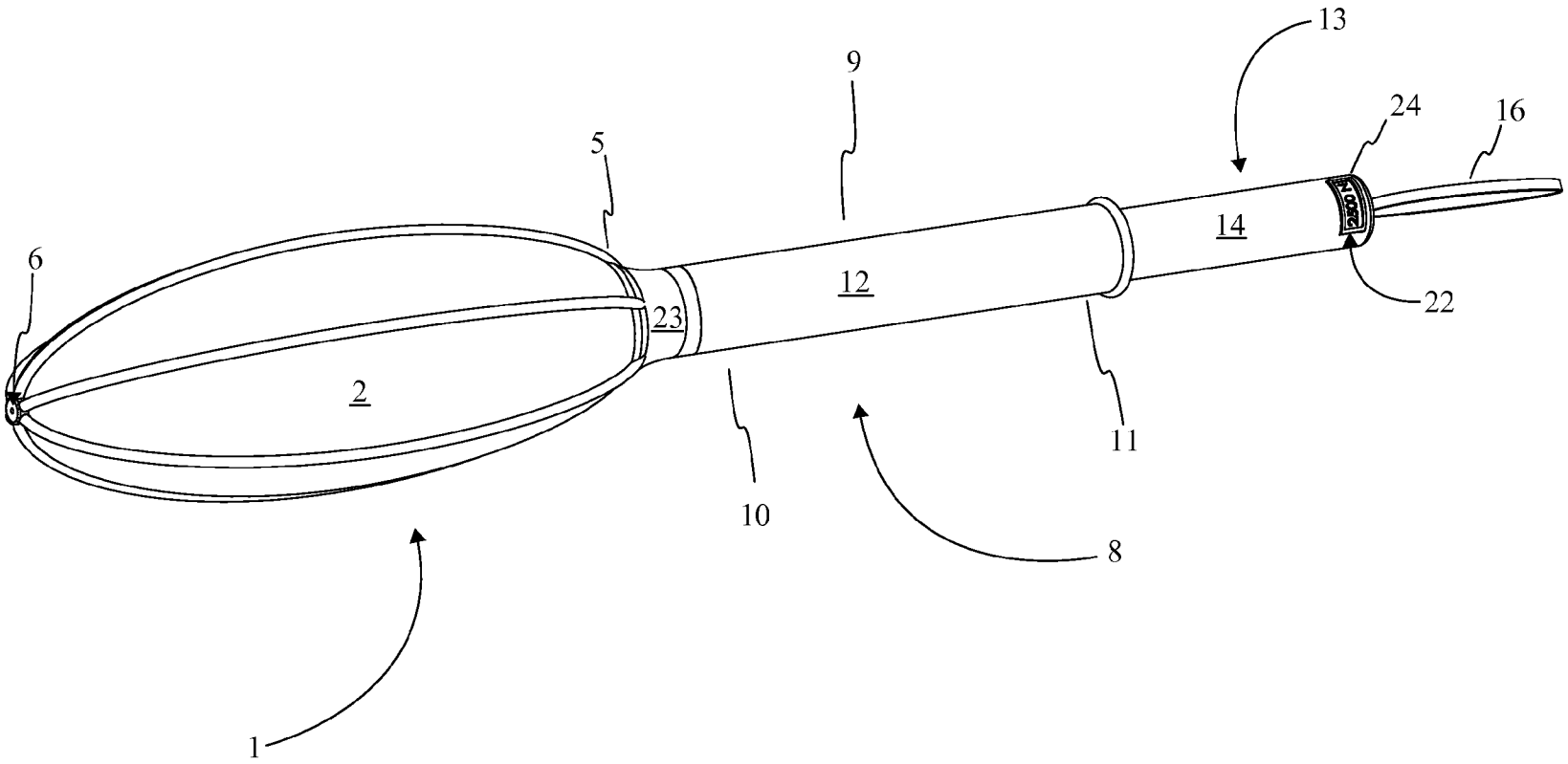
FIG. 6 is a perspective view displaying the elongated focus pad with a sensor system configured with the force sensor positioned on the barrel.
Figure 7:
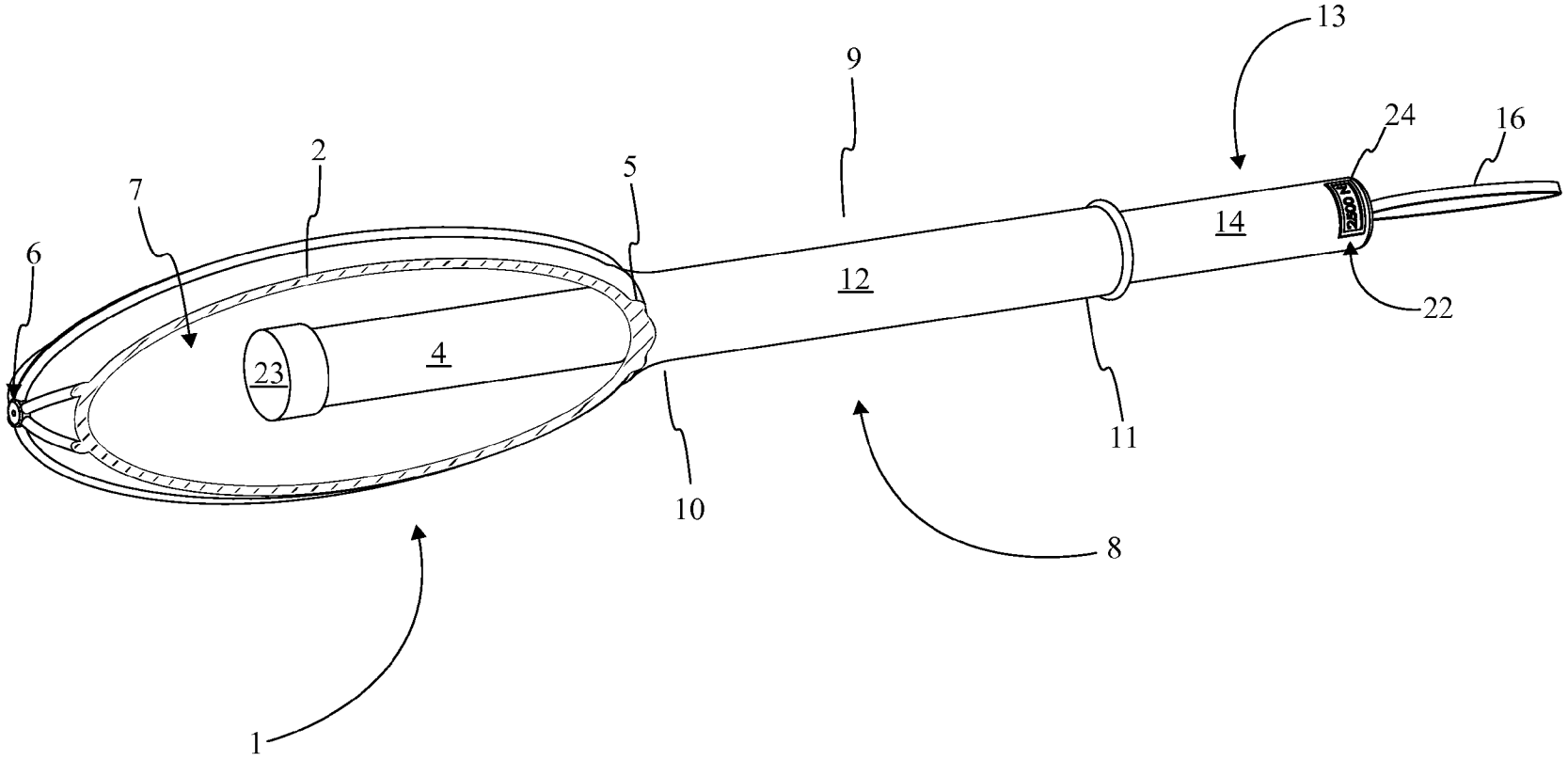
FIG. 7 is a partial cross sectional view displaying the elongated focus pad with a sensor system configured with the force sensor within the target section.

Referencing FIG. 5-7, in an embodiment of the present invention, the target section 1 comprises an inflation valve 6 and a bladder 7. The bladder 7 is a fluid filled sack that is positioned within the interior of the target section 1. The bladder 7 is enclosed between the padded exterior 2 and the first core mount 4, where the bladder 7 surrounds the first core mount 4 while the bladder 7 is surrounded by the padded exterior 2. The bladder 7 provides the target section 1 with a light weight and flexible means of absorbing impact that similar to the foam padding interior of traditional focus mitts. The inflation valve 6 functions as the means of inflating the bladder 7 with air or another gas. The inflation valve 6 is in fluid communication with the bladder 7. The inflation valve 6 traverses into the bladder 7 by way of the padded exterior 2. The inflation valve 6 is peripherally positioned on the target section 1. The positioning of the inflation valve 6 provides minimal interference with the functionality of the elongated focus pad. It should be noted that in an embodiment of the present invention the inflation valve 6 is positioned opposite the barrel mount 5.

Referencing FIG. 2-6, the barrel 8 is a cylindrical component of the elongated focus pad positioned between the target section 1 and the handle 13. The barrel 8 distances the target section 1 from the handle 13. The barrel 8 surrounds the flexible region 20 of the core 17. The positioning of the flexible region 20 within the barrel 8 provides the target section 1 with additional flexibility when absorbing impacts from strikes. It should be noted that the barrel 8 can provide additional rigidity to the flexible region 20 of the core 17 or be utilized mainly as a sleeve. In the current embodiment of the present invention, the barrel 8 comprises an elongated body 9 and a padded layer 12. The elongated body 9 provides the barrel 8 with the needed length to distance the target section 1 from the handle 13. The padded layer 12 is the exterior of the barrel 8 that is provided as a means of reducing harm if the barrel 8 is accidently struck.

Referencing FIG. 1-3, the elongated body 9 distances the target section 1 from the handle 13. The distancing of the target section 1 from the handle 13 reduces the impact from a strike felt by a trainer. The elongated body 9 comprises a first end 10 and a second end 11. The first end 10 and the second end 11 are positioned opposite across the elongated body 9. The first end 10 is the region of the barrel 8 that is coincident the barrel mount 5. The second end 11 is the region of the barrel 8 that is coincident with the handle 13. The flexible region 20 of the core 17 is found positioned between the first end 10 and the second end 11.

Referencing FIG. 4-5, the padded layer 12 is peripherally positioned around the elongated body 9. The padded layer 12 is coincident with the padded exterior 2. The padded layer 12 protects against injury in case the barrel 8 is accidently struck during a training session. The padded layer 12 peripherally surrounds the flexible region 20. It should be noted that the padded layer 12, in the current embodiment of the present invention, is constructed of similar material to the padded exterior 2. Additionally, it should be noted that the padded layer 12 is not necessarily the same thickness as the padded exterior 2.

Referencing FIG. 2-5, the core 17 is the portion of the elongated focus pad that provides the target section 1 with elasticity. The core 17 is centrally positioned with the target section 1, the barrel 8, and the handle 13. The core 17 is found enclosed within the target section 1, the barrel 8, and the handle 13. The core 17 comprises a first section 18, a flexible region 20, and a second section 19. The first section 18 is the portion of the core 17 that is coincident with the first core mount 4. The flexible region 20 is a bellows shaped portion that provides the elasticity to the elongated focus pad. The second section 19 is provided as the portion of the core 17 that is coincident with a second core mount 15 found within the handle 13.

Referencing FIG. 3-5, the first section 18 and the second section 19 are oppositely positioned portions of the core 17 that are securely engaged to complementary mounts on the target section 1 and the handle 13 respectively. The first section 18 is positioned opposite the second section 19 across the flexible region 20. The first section 18 is secured to the first core mount 4. The engagement between the first section 18 and the first core mount 4 can be accomplished by a plurality of means but preferably through a low profile impact resistant fastening means to ensure durability of the connection. The second core mount 15 is centrally positioned within the handle 13. The positioning of the second section 19 improves manipulation of the elongated focus pad. The second section 19 is secured to the second core mount 15. The engagement between the second section 19 and the second core mount 15 can be accomplished by a plurality of fastening means. It should be noted that the engagement means utilized to secure the first section 18 to the first core mount 4 may differ from the engagement means utilized to secure the second section 19 to the second core mount 15 as the second section 19's engagement do not require as much impact resistance.

Referencing FIG. 3-5, the flexible region 20 of the core 17 is elastically positioned within the barrel 8. The positioning of the flexible region 20 provides the elongated focus pad with the elasticity needed to flex and absorb impacts received by the target section 1. The flexible region 20 is shaped similar to a bellows. The particular shape of the flexible region 20 provides a light weight construction that facilitates manipulation by a trainer. The particular shape of the flexible region 20 allows for the core 17 to quickly return back to a resting position following a strike due to the inherent properties associated with a bellows shape 21. It should be noted that while the current embodiment utilizes a bellows shape 21 to provide the elasticity to the flexible region 20, additional embodiments may utilize any means that conforms to the construction and positioning of the core 17 while not interfering with the functionality of the present invention.

Referencing FIG. 2 and FIG. 3, the handle 13 is the portion of the elongated focus pad that is manipulated by a trainer. The handle 13 is positioned adjacent to the barrel 8 opposite the target section 1. In the current embodiment of the present invention, the handle 13 comprises a gripping section 14, a second core mount 15, and a lanyard 16. The gripping section 14 is the exterior portion of the handle 13 that is provided with particular surface features that improve a trainers grip while manipulating the handle 13. The second core mount 15 is provided as the portion of the handle 13 that is coincident with the second section 19 of the core 17. The lanyard 16 is provided as a secondary means of securing the elongated focus pad to the trainer's hand.

Referencing FIG. 2-5, the gripping section 14 is peripherally positioned around the exterior of the handle 13. The positioning of the gripping section 14 facilitates engagement by a trainer. The second core mount 15 is centrally positioned within the handle 13. The positioning of the second section 19 improves manipulation of the elongated focus pad. The second section 19 is secured to the second core mount 15. The engagement between the second section 19 and the second core mount 15 can be accomplished by a plurality of fastening means. The component relation between the gripping section 14 and the second core mount 15, provides the elongated with improved balance while manipulated by a trainer. The lanyard 16 is terminally secured to the handle 13. The lanyard 16 is positioned opposite the barrel 8 across the handle 13. The lanyard 16 is provided with sufficient length to wrap around a trainers wrist and prevent a loss of grip with the elongated focus pad. It should be noted that the lanyard 16 may be constructed of materials with variable elastic properties allowing the lanyard 16 to retain itself more securely to a trainer's wrist.

Referencing FIG. 6 and FIG. 7, in an embodiment of the present invention, the elongated focus pad comprises a sensor system 22. The sensor system 22 is provided as a means of gauging the force of an impact to the target section 1 and displaying an output. The output can be displayed in known units or as a qualitative value associated with the particular sensor system 22. The sensor system 22 comprises a force sensor 23 and a sensor display 24. The force sensor 23 is the instrument utilized to gauge a force of an impact to the target section 1. The force sensor 23 is communicably coupled to the sensor display 24. The sensor display 24 is the output means utilized to show readings from the force sensor 23. Although the sensor system 22 is not explicitly described as being a mechanical or electrical system, it should be noted that either system may be implemented and that additional component requirements would be understood as obvious.

Referencing FIG. 6 and FIG. 7, the force sensor 23 is an instrument that gauges the force of an impact to the strike zone. The force sensor 23 can be accomplished as a force transducer in an electrical system or as a pneumatic sensor in a mechanical system. The force sensor 23 is communicably coupled to the sensor display 24. The engagement between the force sensor 23 and the sensor display 24 can be provided through any means that allow the measurement from the force sensor 23 to be shown by the sensor display 24. The force sensor 23 is found positioned adjacent to the core 17. The positioning of the force sensor 23 to the core 17 enables the measurements to be based on the elastic movement of the core 17. In an embodiment of the present invention, the force sensor 23 is positioned within the barrel 8. The positioning of the force sensor 23 within the barrel 8 provides more accurate measurement of the elastic movement of the flexible region 20 of the core 17. In an embodiment of the present invention, the force sensor 23 is positioned within the target section 1. The positioning of the force sensor 23 within the target section 1 provides measurements for the elastic movement of the core 17 as well as compression of the padded exterior 2 of the target section 1.

Referencing FIG. 6 and FIG. 7, the sensor display 24 is provided as the output means for showing the measurements collected by the force sensor 23. The sensor display 24 can be accomplished as by an electrically powered display that includes but not limited to an LCD screen or an LED array, in an electrical system or as a pneumatic gauge in a mechanical system. The sensor display 24 is mounted on the handle 13. The positioning of the sensor display 24 on the handle 13 reduces the likelihood of the sensor display 24 being accidentally struck during a training session. It should be noted that the sensor display 24 can be positioned in various arrangements of the handle 13 provided the positioning does not interfere with the manipulation of the handle 13 by a trainer.

The invention is a training device, henceforth referred to as an "elongated focus pad", which serves as a punching target for a boxer. The invention is designed to improve boxer focus and speed both offensively and defensively while reducing the likelihood of injury due to wear and tear for trainers holding the elongated focus pad. The elongated focus pad is utilized in pairs during a training session and functions in a similar manner as a conventional focus mitt.

In an embodiment of the invention, the invention comprises a core. The core comprises a cylindrical extrusion of material with a first end and a second end. The core is composed of a flexible material. The core comprises a first cylindrical section and a second cylindrical section adjacent to the first end and the second end of the core, respectively. A plurality of bellows is situated along a portion of the core between the two cylindrical sections adjacent to the first end and second end of the core. The bellows facilitate bending of the core along the portion of the core on which the bellows are located. The core is capable of providing sufficient resistance to a boxer's punch while also giving way sufficiently to protect the trainer holding the elongated focus pad.

In an embodiment of the invention, the invention comprises a target zone barrel. The target zone barrel comprises a tubular extrusion of material with a first end and a second end. The tubular extrusion of material forms the barrel portion of the target zone barrel. The first end of the tubular extrusion features a circular opening. The circular opening features the same diameter as those of the non-bellow portions of the core. The second end of the tubular extrusion comprises an approximately bulb-shaped extrusion. The bulb-shaped extrusion forms the target zone portion of the target zone barrel. The target zone barrel interior comprises a removed section of material that is designed and sized such that the core may slot into and be retained within the interior. In the preferred embodiment of the invention, the tubular barrel portion of the target zone barrel is composed of pliable, rubberized foam. This portion of the target zone barrel corresponds to the portion of the core featuring a plurality of bellows. The pliable, rubberized foam allows the target zone barrel to deform and bend along with the bellow portion of the core. In the preferred embodiment of the invention, the bulb-shaped target zone of the target zone barrel is composed of shock-absorbing, rubberized foam. This allows the target zone barrel to dampen the shock impulse and dissipate the kinetic energy caused by a boxer's punch to the target zone. The interior of the target zone portion of the target zone barrel is designed and sized to accommodate the second cylindrical section of the core. The exterior surface of the target zone may be designed to draw the attention of a boxer. For example, the target zone may be denoted by a bright color.

In an embodiment of the invention, the invention comprises a handle. The handle comprises a first tubular section and a second tubular section each with a first end and a second end. The first tubular section features an inner diameter that is equal to the diameter of the first cylindrical section of the core and an outer diameter that is slightly larger than the diameter of the first cylindrical section of the core. The second tubular section is attached directly to the first tubular section and features a much smaller length than that of the first tubular section. The first end of the second tubular section is attached to the second end of the first tubular section. As a result, the first end of the first tubular section and the second end of the second tubular extrusion remain open to the exterior environment. The second tubular section features an inner diameter that is equal to the diameter of the first cylindrical section of the core and an outer diameter that is equal to the diameter of the barrel portion of the target zone barrel. The combined length of the first tubular section and the second tubular section is approximately the same as that of the first cylindrical section of the core. In the preferred embodiment of the invention, the handle is composed of rubber to assist a trainer in maintaining a secure grip on the handle.

In an embodiment of the invention, the invention comprises a strap cap. The cap comprises a first cylindrical section, a second cylindrical section, and a strap. The first cylindrical section features a diameter that is equal to the inner diameter of the handle. The second cylindrical section features a diameter that is equal to the outer diameter of the first tubular section of the handle. The strap is attached directly to the section cylindrical section of the handle.

The object of the invention is to provide boxers and trainers with a training device that functions in a similar manner as a conventional focus mitt while protecting the long term health of trainers. The elongated focus pad is utilized in pairs, much like a conventional focus mitt. The elongated focus pad provides a target for receiving boxer punches and may be utilized to deliver offensive strikes against the boxer as well. In this manner, the invention is capable of developing both offensive and defensive boxer techniques. The invention is specifically designed in a manner such that the elongated focus pad gives way with less resistance than conventional focus mitts when struck while still providing a sufficient counterforce to a boxer's punch. This greatly reduces the sudden shock imparted on the shoulders of a trainer holding elongated focus pads and receiving the boxer punches. The elongated focus pads are not intended to replace focus mitts and may be utilized to complement the training provided by the focus mitts. The elongated focus pads place emphasis on developing speed and defensive technique. Due to the thin profile of the elongated focus pads, a trainer may more realistically deliver offensive strikes to a boxer as well as increase the speed with which the simulated punches are thrown. By providing a more streamlined and dynamic training experience, the elongated focus pads are capable of greatly improving a boxer's reaction times and reflexes. An additional benefit of the thin profile of the elongated focus pads is the presentation of a smaller punching target. This proves beneficial in improving a boxer's hand-eye coordination.

An embodiment of the invention features the integration of measurement sensors housed within the elongated focus pad. The sensors are capable of collecting data related to a boxer's punches such as the rate at which punches are thrown as well as the force of impact resulting from the punches. The data may be compiled and utilized by boxers and trainers to improve the boxers' technique.

In an embodiment, the invention is intended for use as a training tool for boxing. However, embodiments of the invention may be utilized in various other combat sports such as mixed martial arts (MMA). Embodiments of the invention utilized in training for a sport such as MMA may be specially designed to accommodate the sport. For example, an embodiment of the invention utilized in MMA training may be composed of sturdier material to account for the force of impact resulting from kicks.

Although the invention has been explained in relation to its preferred embodiment, it is to be understood that many other possible modifications and variations can be made without departing from the spirit and scope of the invention as hereinafter claimed.

What is claimed is:

1. An elongated focus pad comprises:

a target section;

a barrel;

a handle;

a core;

the target section comprises a padded exterior, a first core mount, and a barrel mount;

the barrel comprises an elongated body and a padded layer;

the handle comprises a gripping section, a second core mount, and a lanyard;

the core comprises a first section, a second section, and a flexible region;

the elongated body comprises a first end and a second end;

the target section, the core, the barrel, and the handle being centrally aligned;

the core being enclosably positioned within the target section, the barrel and the handle;

the barrel being positioned between the target section and the handle;

the barrel mount being immediately adjacent to the elongated body, wherein the first end is coincident with the barrel mount;

the padded exterior being peripherally positioned on the target section;

the first core mount being centrally positioned within the target section;

the flexible region being positioned between the first section and the second section;

the core being coincidentally engaged to the first core mount by way of the first section;

the flexible region being elastically positioned within the elongated body;

the flexible region being peripherally surrounded by the padded layer;

the handle being immediately adjacent to the elongated body, wherein the handle is coincident with the second end;

the gripping section being peripherally positioned on the handle;

the second core mount being centrally positioned within the handle;

the core being coincidentally engaged to the second core mount by way of the second section; and the lanyard being positioned opposite the barrel across the handle.

2. The elongated focus pad as claimed in claim 1, wherein the flexible region comprises a bellows shape.

3. The elongated focus pad as claimed in claim 1 comprises:

a sensor system;

the sensor system comprises a force sensor and a sensor display;

the force sensor being positioned adjacent to the core;

the force sensor being communicably coupled to the sensor display; and the sensor display being mounted on the handle.

4. The elongated focus pad as claimed in claim 3 wherein, the force sensor is positioned within the target section.

5. The elongated focus pad as claimed in claim 3 wherein the force sensor is positioned within the barrel.

6. The elongated focus pad as claimed in claim 1 comprises:

the target section comprises an inflation valve and a bladder;

the inflation valve being peripherally positioned on the target section;

the bladder being enclosed between the padded exterior and the first core mount;

the inflation valve traverse into the bladder by way of the padded exterior; and the inflation valve being in fluid communication with the bladder.

7. An elongated focus pad comprises:

a target section;

a barrel;

a handle;

a core;

the target section comprises a padded exterior, a first core mount, and a barrel mount;

the barrel comprises an elongated body and a padded layer;

the handle comprises a gripping section, a second core mount, and a lanyard;

the core comprises a first section, a second section, and a flexible region;

the elongated body comprises a first end and a second end;

the flexible region comprises a bellows shape, wherein the bellows shape provides the elasticity to the core;

the target section, the core, the barrel, and the handle being centrally aligned;

the core being enclosably positioned within the target section, the barrel and the handle;

the barrel being positioned between the target section and the handle;

the barrel mount being immediately adjacent to the elongated body, wherein the first end is coincident with the barrel mount;

the padded exterior being peripherally positioned on the target section;

the first core mount being centrally positioned within the target section;

the flexible region being positioned between the first section and the second section;

the core being coincidentally engaged to the first core mount by way of the first section;

the flexible region being elastically positioned within the elongated body;

the flexible region being peripherally surrounded by the padded layer;

the handle being immediately adjacent to the elongated body, wherein the handle is coincident with the second end;

the gripping section being peripherally positioned on the handle;

the second core mount being centrally positioned within the handle;

the core being coincidentally engaged to the second core mount by way of the second section; and the lanyard being positioned opposite the barrel across the handle.

8. The elongated focus pad as claimed in claim 7 comprises:

a sensor system;

the sensor system comprises a force sensor and a sensor display;

the force sensor being positioned adjacent to the core;

the force sensor being communicably coupled to the sensor display; and the sensor display being mounted on the handle.

9. The elongated focus pad as claimed in claim 8 wherein, the force sensor is positioned within the target section.

10. The elongated focus pad as claimed in claim 8 wherein the force sensor is positioned within the barrel.

11. The elongated focus pad as claimed in claim 7 comprises:

the target section comprises an inflation valve and a bladder;

the inflation valve being peripherally positioned on the target section;

the bladder being enclosed between the padded exterior and the first core mount;

the inflation valve traverse into the bladder by way of the padded exterior; and the inflation valve being in fluid communication with the bladder.

12. An elongated focus pad comprises:

a target section;

a barrel;

a handle;

a core;

a sensor system;

the target section comprises a padded exterior, a first core mount, and a barrel mount;

the barrel comprises an elongated body and a padded layer;

the handle comprises a gripping section, a second core mount, and a lanyard;

the core comprises a first section, a second section, and a flexible region;

the sensor system comprises a force sensor and a sensor display;

the elongated body comprises a first end and a second end;

the flexible region comprises a bellows shape, wherein the bellows shape provides the elasticity to the core;

the target section, the core, the barrel, and the handle being centrally aligned;

the core being enclosably positioned within the target section, the barrel and the handle;

the barrel being positioned between the target section and the handle;

the barrel mount being immediately adjacent to the elongated body, wherein the first end is coincident with the barrel mount;

the padded exterior being peripherally positioned on the target section;

the first core mount being centrally positioned within the target section;

the flexible region being positioned between the first section and the second section;

the core being coincidentally engaged to the first core mount by way of the first section;

the flexible region being elastically positioned within the elongated body;

the flexible region being peripherally surrounded by the padded layer;

the force sensor being positioned adjacent to the core;

the force sensor being communicably coupled to the sensor display;

the sensor display being mounted on the handle;

the handle being immediately adjacent to the elongated body, wherein the handle is coincident with the second end;

the gripping section being peripherally positioned on the handle;

the second core mount being centrally positioned within the handle;

the core being coincidentally engaged to the second core mount by way of the second section; and the lanyard being positioned opposite the barrel across the handle.

13. The elongated focus pad as claimed in claim 12 wherein, the force sensor is positioned within the target section.

14. The elongated focus pad as claimed in claim 12 wherein the force sensor is positioned within the barrel.

15. The elongated focus pad as claimed in claim 12 comprises:

the target section comprises an inflation valve and a bladder;

the inflation valve being peripherally positioned on the target section;

the bladder being enclosed between the padded exterior and the first core mount;

the inflation valve traverse into the bladder by way of the padded exterior;

the inflation valve being in fluid communication with the bladder.

* * * * *